US006317985B1

(12) United States Patent
Huang

(10) Patent No.: US 6,317,985 B1
(45) Date of Patent: Nov. 20, 2001

(54) LOCKING DEVICE FOR USE WITH A UTILITY KNIFE

(76) Inventor: Richard Huang, No. 12, Road 41 Industry Area, Shi-Tuen Area, Taichung City (TW)

( * ) Notice: Subject to any disclaimer, the term of this patent is extended or adjusted under 35 U.S.C. 154(b) by 0 days.

(21) Appl. No.: 09/532,744

(22) Filed: Mar. 22, 2000

(51) Int. Cl.[7] ..... B26B 1/08; B26B 1/10

(52) U.S. Cl. ..... 30/162; 30/125; 30/332; 292/156

(58) Field of Search ..... 30/125, 162, 153, 30/332, 333, 340, 335; 292/138, 156; 24/455

(56) References Cited

U.S. PATENT DOCUMENTS 1,642,501 * 9/1927 Knell ..... 292/156
5,121,544 * 6/1992 Gilbert ..... 30/162
5,644,843 * 7/1997 Young ..... 30/162 X
5,864,952 * 2/1999 Chung ..... 30/332 X

* cited by examiner

*Primary Examiner*—Douglas D. Watts
(74) *Attorney, Agent, or Firm*—Dougherty & Troxell

(57) ABSTRACT

A utility knife is provided with a feature of easy replacement of the blade and a characteristic that the utility knife body halves are prevented from separating from each other. The utility knife has a lock which is able to enhance the assembly between the body halves, such that the user is able use the knife without worrying the two halves will separate with each other and endanger the user. The locking device has a retainer movably engaged with an inclined top face of a pressing stop, such that the retainer is forced to move. When the retainer moves, an extension is then alternatively and movably received in a receiving hole in the retainer to alternatively assemble the two halves.

5 Claims, 6 Drawing Sheets

LOCKING DEVICE FOR USE WITH A UTILITY KNIFE

CROSS REFERENCE TO THE APPLICATION

Not applicable.

BACKGROUND OF THE INVENTION

1. Field of the Invention

The present invention relates to a utility knife, in particular, an improved utility knife with easy assembly and disassembly feature. The utility knife has an innovative locking device mounted therein to allow two half covers of the utility knife to be assembled and disassembled easily.

2. Description of Related Art

A conventional utility knife for woodworking normally has two half covers, a bracket securely received in one of the half covers for receiving a blade therein and a pushbutton slidably mounted on top of the two half covers and integrally connected with the bracket, such that the blade received in the bracket is able to extend out from a distal end of the knife. Furthermore, a plate with multiple recesses defined therein is provided to position the pushbutton. That is, when the pushbutton is moved, the pushbutton is able to rest in any one of the recesses so that the extension of the blade is divided into several parts until it is fully extended. The blade usually needs replacement due to various cutting works involved. In order to facilitate the completion of the work, whether the two half cover are easily opened and closed becomes an important issue.

From the existed product, it is understood that a lot of the utility knife uses screws to fasten the two half covers. That is to say, every time the worker wants to replace the blade inside the two half covers, the worker will have to prepare a screw driver to unscrew the two half covers and after the replacement, the worker still has to use the screw driver to fasten the two half covers again, which is troublesome and labor inefficient.

In order to mitigate and/or obviate the above disadvantages, the invention provides an improved utility knife having a locking device to strengthen the connection between the upper cover and the lower cover.

SUMMARY OF THE INVENTION

The main objective of the invention is to provide a locking device mounted between the two half covers to facilitate the assembly and disassembly of the two half covers.

Another objective of the invention is to strengthen the closure of the two half covers so as to ensure the smooth sliding movement of the blade within the knife.

Still another objective of the invention is to provide a resilient force between the two half covers such that when the two half covers are disassembled, the disassembly of the two half covers is facilitated.

A further objective of the invention is to provide a slide-proof material on the handle of the knife, such that when the knife of the invention is in use, the user will have a better grip.

DETAILED DESCRIPTION OF PREFERRED EMBODIMENT

Figure 1:
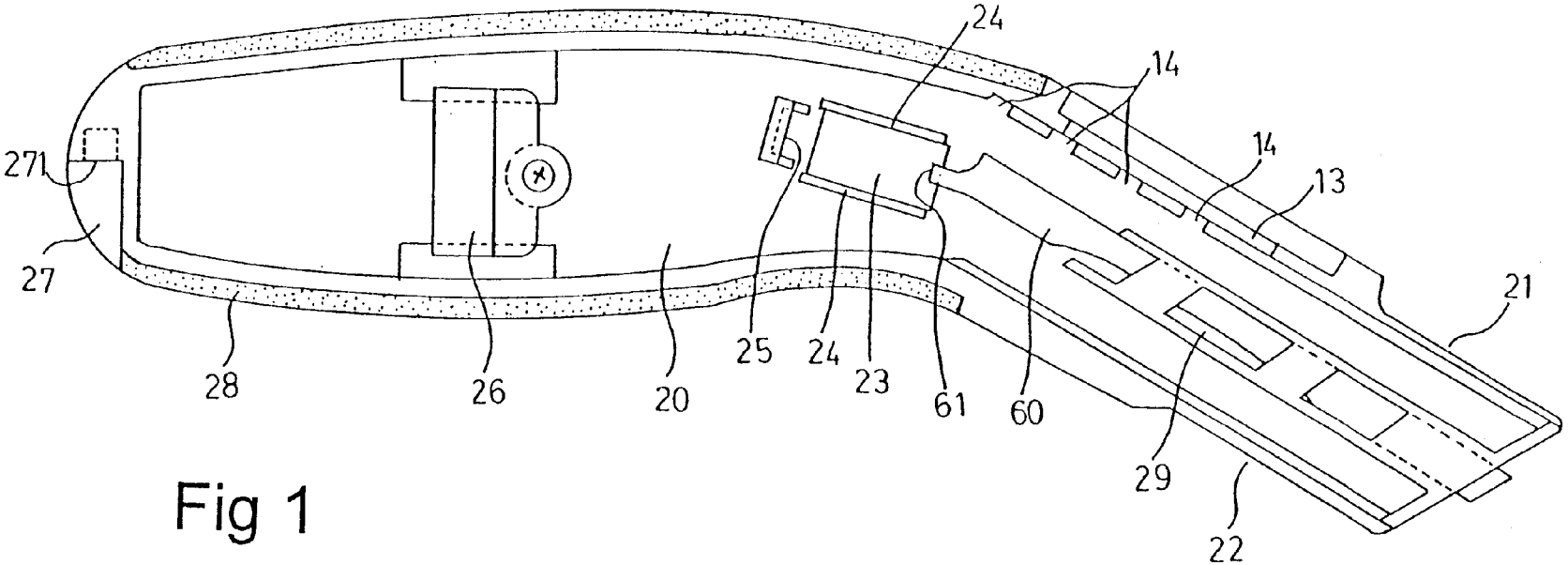
FIG. 1 is a top plan view showing a first half cover of the utility knife in accordance with the present invention.

From the accompanied drawings, it is to be noted that an ordinary utility knife usually has a casing (10) composed of a first half cover (20) and a second half cover (30). The casing (10) has a front end (12) with a slit (121) defined therein and a slot (13) defined in a top face thereof. A pushbutton (40) integrally formed with a bracket (41) for supporting a blade (42) thereon is slidably mounted on the top face of the casing (10) and movable along the slot (13). Multiple recesses (14) are defined in an inner wall defining the slot (13), such that when the blade (42) together with the bracket (41) is pushed by the pushbutton (40) and extend out from the slit (121), due to the provision of the recesses (14), the bracket (41) can rest in any one of the recesses (14) so as to divide the extension movement of the blade (42) into several sections. Furthermore, the first half cover (20) has two limiting cutouts (21,22) oppositely defined in a front portion thereof and the second half cover (30) has two limiting walls (31,32) oppositely formed to correspond to the two limiting cutouts (21,22) of the first half cover (20). Therefore, when the first half cover (20) and the second half cover (30) are connected with each other, the limiting cutouts (21,22) and the limiting walls (31,32) are able to provide positional stability and prevent side-slide between the two half covers (20,30). A stop (37) is transversely formed between the two limiting walls (31,32) and the slit (12) is thus defined through the stop (37) so as to allow the blade (42) to extend through. The above description of the utility knife is to present the general structure of the existed knife. Therefore, the introduction of the parts is not described according to the sequence of the drawings.

With reference to FIG. 1, the first half cover (20) has an elongate path (23) defined in a mediate portion thereof, a wall (24) formed on two opposite sides defining the path (23), a seat (25) formed on an end of the path (23), a leaf spring (26) securely mounted on a rear portion thereof, a cutout (27) with a pivot hole (271) defined in a face defining the cutout (27), a sliding-proof material (28) provided outside a holding portion (11) of the knife and a sliding seat (29) formed in a front portion thereof for receiving therein an extension (60).

Figure 2:
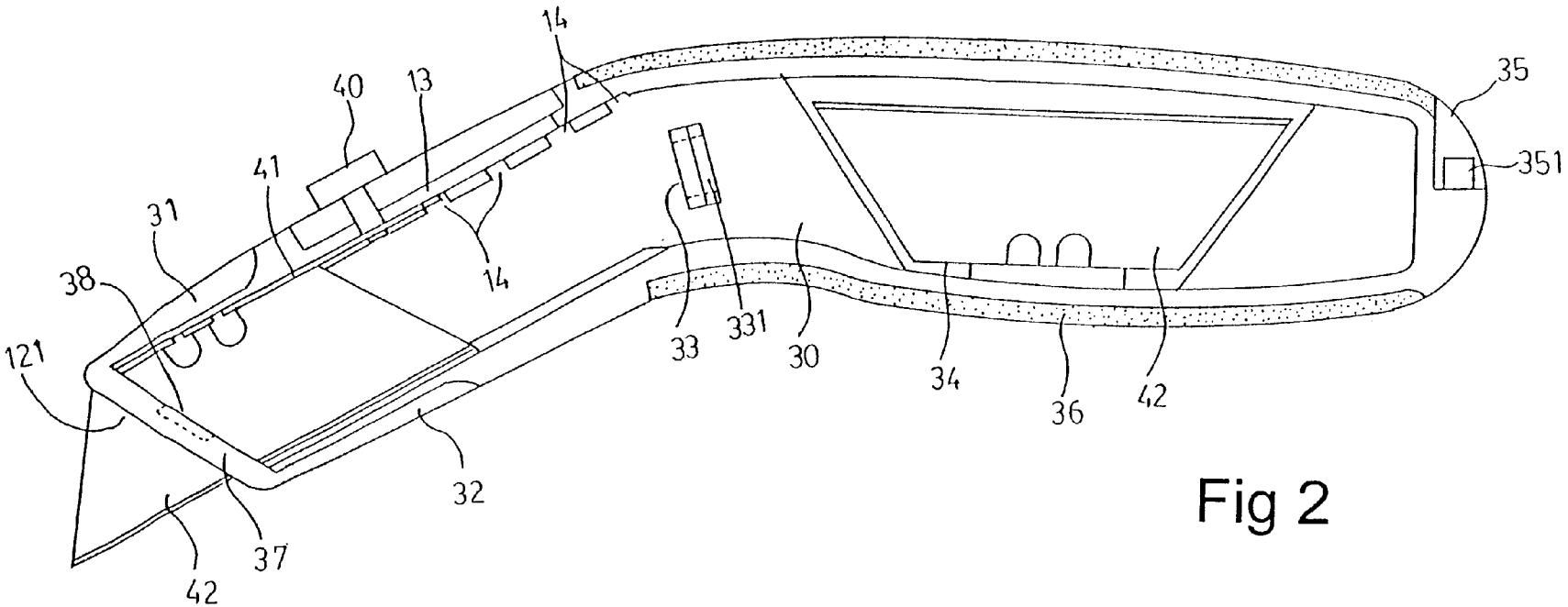
FIG. 2 is a top plan view showing a second half cover o the utility knife in accordance with the present invention.

FIG. 2 shows that the second half cover (30) has a pressing stop (33) provided with an inclined top face (331) and formed on a mediate portion thereof, a chamber (34) formed adjacent a rear portion thereof for storing spare blades therein and a cutout (35) defined in a rear end thereof and having a shaft (351) formed to correspond to the pivot hole (271) of the first half cover (20). Furthermore, a receiving trough (38) (shown in dashed line) is defined in the stop (37) for receiving a free end of the extension (60).

Figure 3:
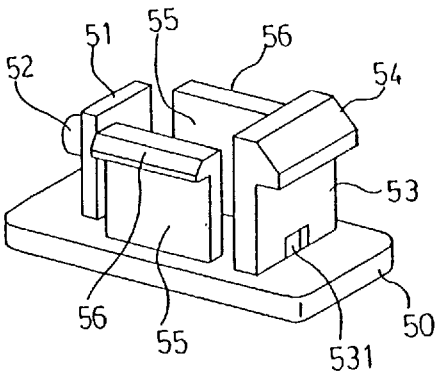
FIG. 3 is a perspective view showing a retainer in accordance with the present invention.

Referring to FIG. 3, a retainer (50) has a first wall (51) with a protrusion (52) formed to extend out therefrom, a second wall (53) formed opposite to the first wall (51) and having an inclined roof (54) formed on a top thereof and a retaining hole (531) defined in a bottom opposite to the inclined roof (54) and two side walls (55) each oppositely formed with each other and between the first and the second walls (51,53). Each of the side walls (55) has a guided ridge (56) formed on a free side thereof so as to correspond to the walls (24) of the first half cover (20).

Figure 4:
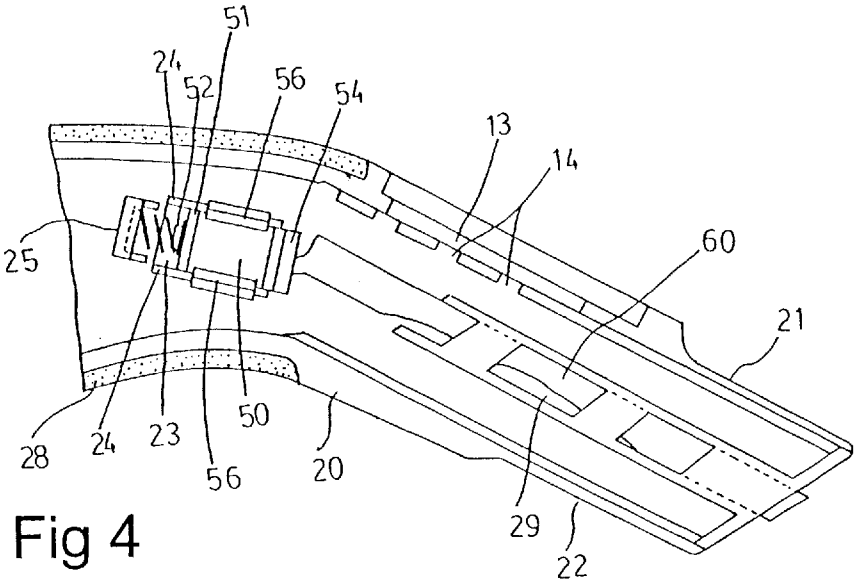
FIG. 4 is a schematic view showing the assembly of the retainer into the first half cover.
Figure 5:
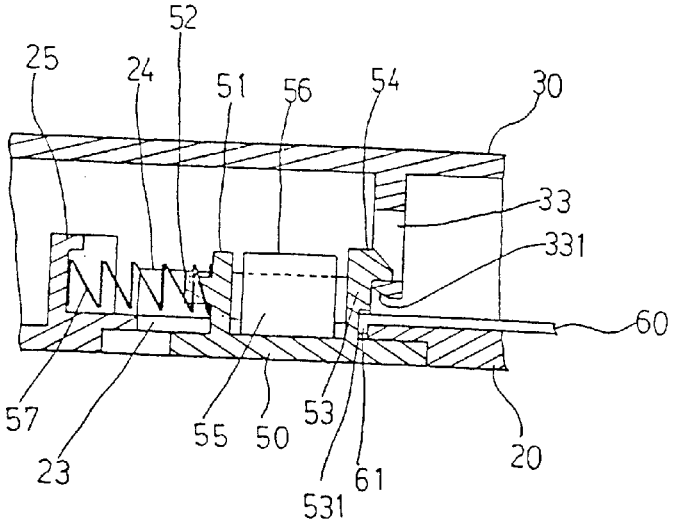
FIG. 5 is a partially enlarged cross sectional view showing the engagement between the first half cover and the second half cover.
Figure 6:
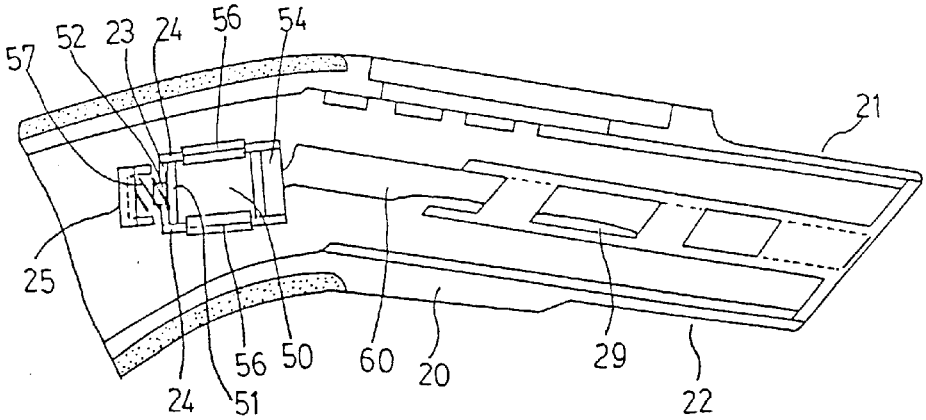
FIG. 6 is a schematic view showing an extension shown in FIG. 4 is inserted into the first half cover.
Figure 8:
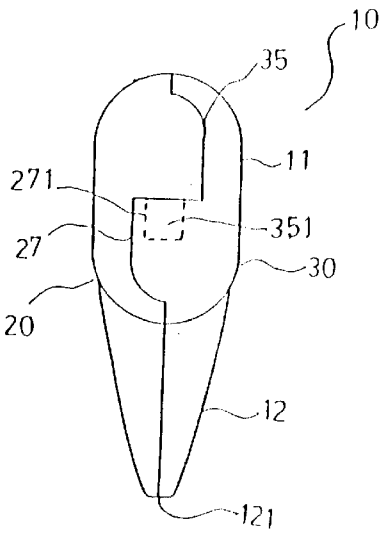
FIG. 8 is a schematic view showing the rear portion of the utility knife.
Figure 7:
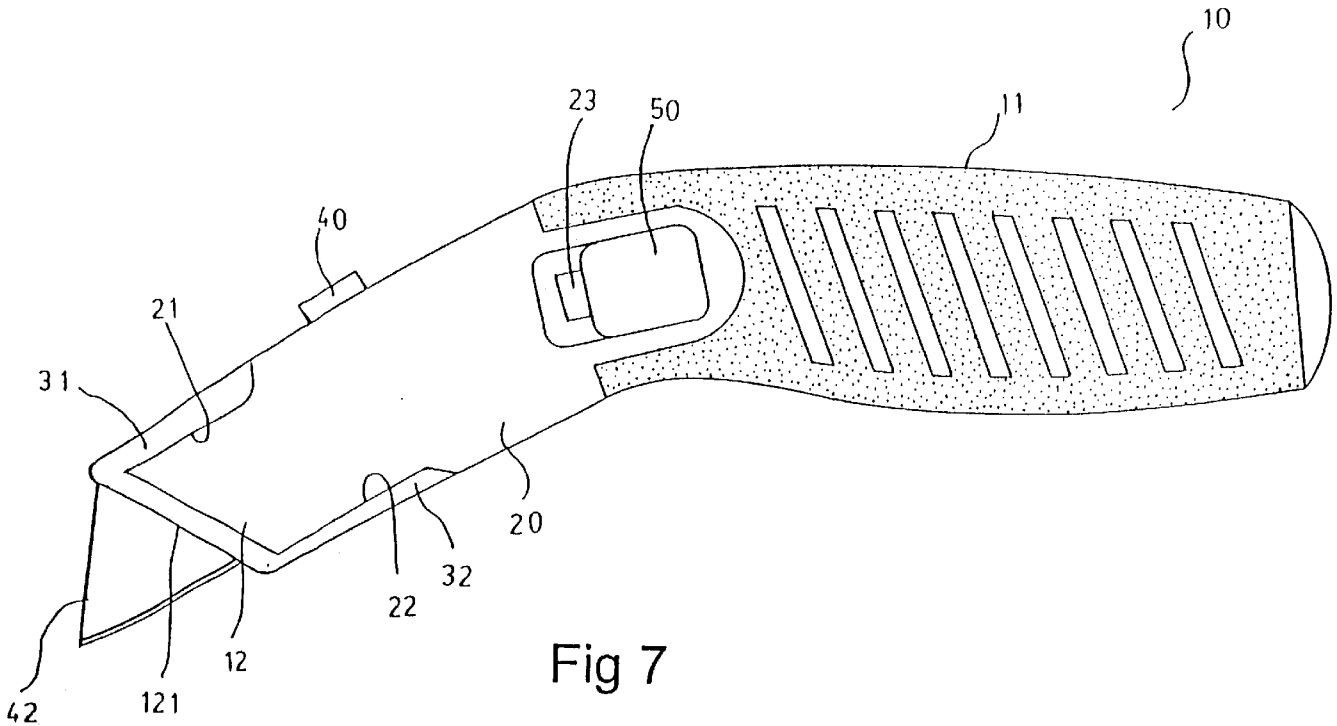
FIG. 7 is a side view showing the overall appearance of the utility knife of the present invention.

Referring to FIGS. 4, 5 and 6, after the side walls (55) of the retainer (50) are inserted between the two walls (24) along the path (23), the retaining ridges (56) are therefore slid on top of the walls (24). When the retaining ridges (56) are fully engage with the walls (24), the retainer (50) is thus only able to move reciprocally in a linear manner within the path (23). A spring (57) located between the seat (25) and the retainer (50) with one end abutted to the protrusion (52) of the first wall (51) is able to provide recoil force to the first wall (51). Thus, the retainer (50) is able to move back and forth with the help of the spring (57). Meanwhile, a hook (61) formed on a free end of the extension (60) is connected in the retaining hole (531) so as to enable the extension (60) to move along with the retainer (50) in the sliding seat (29).

When the first half cover (20) and the second half cover (30) are assembled, the shaft (351) is received in the pivot hole (271) of the first half cover (20), thus the first half cover (20) and the second half cover (30) is able to pivot with respect to each other. After the first and the second half covers (20,30) are closed, the inclined roof (54) gradually engages with the inclined top face (331) of the pressing stop (33). The retainer (50) will then be forced to move away from the pressing stop (33) with the side walls (55) sliding along the walls (24) in the path (23). When the retainer (50) is moving away from the pressing stop (33), the spring (57) is compressed to store energy for pushing the retainer (50) back to its original position. After the inclined roof (54) slides over the inclined top face (331) of the pressing stop (33), the inclined roof (54) will engage with the pressing stop (33) with the assistance of the stored energy of the spring (57). However, when the retainer (50) is moving by the stored energy of the spring (57), the extension (60) will also be moved, which allows a free end of the extension (60) to extend out from the from portion of the first half cover (20) and into the receiving trough (38) of the second half cover (30) to secure the assembly between the first and the second half covers (20,30).

Figure 9:
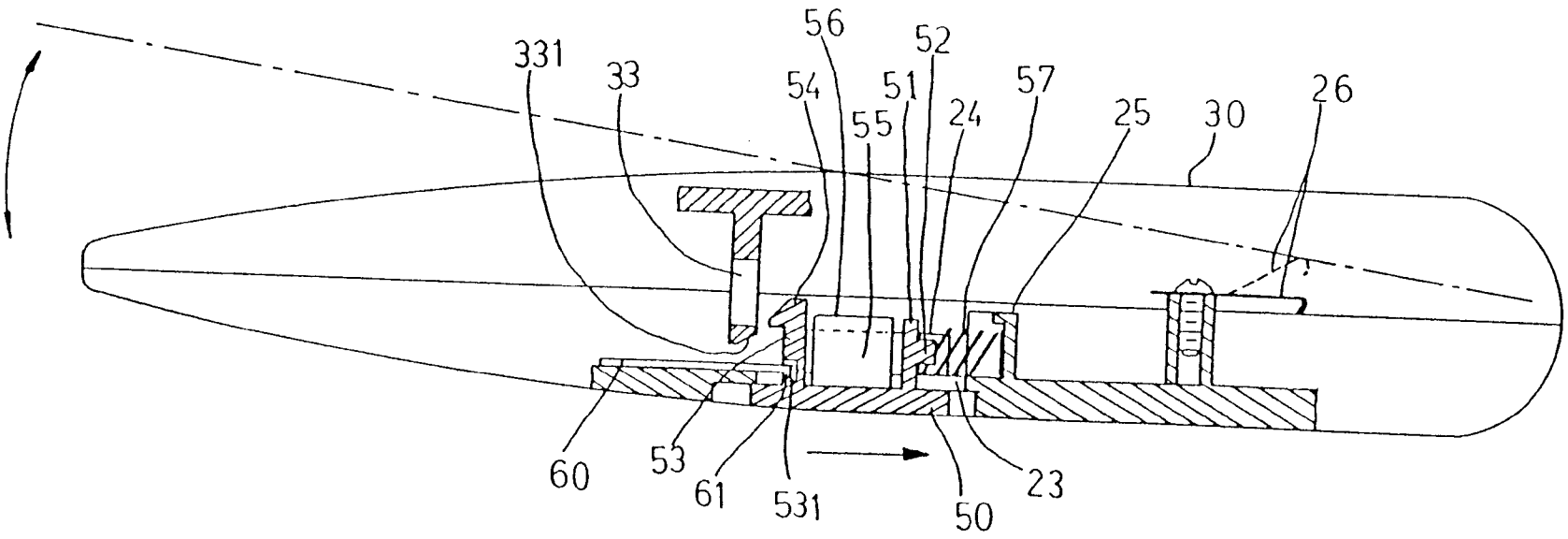
FIG. 9 is a schematic view showing the relative movement of the first half cover with respect to the second half cover.

Referring to FIG. 9, when disassembly of the knife of the invention is necessary for replacing the blade (42) received in the knife, the user only needs to push the retainer (50) rearward to move the inclined roof (54) away from the pressing stop (33) so as to enable the retainer (50) together with the extension (60) to move in the sliding seat (29). Thus, the protruding portion of the extension (60) into the receiving trough (38) thus retracts from the receiving trough (38). Accordingly, the first half cover (20) is able to pivot with respect to the second half cover (30) with the help of the leaf spring (26) to facilitate the opening therebetween.

To sum up, the present invention has the following advantages:

1. easy opening between the first and the second half covers;
2. when the first and the second half covers are opened when necessary, the leaf spring will facilitate the opening therebetween;
3. the engagement between the first and the second half covers are secured so as to ensure the smooth sliding movement of the blade in the knife; and
4. the sliding-proof material ensures the grip of the user.

What is claimed is:

1. A utility knife with a locking device comprising: a casing composed of a first half cover, a second half cover pivotally connected with the first half cover, a pushbutton movably mounted on top of the casing, and bracket integrally formed with the pushbutton for receiving therein a blade, wherein the first half cover has an elongate path defined in a mediate portion thereof, spaced apart walls on two opposite sides of the path, a seat formed at an end of the path, a first spring securely mounted on a rear portion thereof, a first cutout with a pivot hole and a sliding seat formed in a front portion thereof for receiving therein an extension;

the second half cover has a pressing top provided with an inclined top face and formed on a mediate portion thereof, a chamber formed adjacent a rear portion thereof for storing spare blades therein and a second cutout defined in a rear end thereof and having a shaft engaging the pivot hole of the first cutout; and a retainer detachably engaged with the pressing stop and securely connected with an extension such that, when the retainer moves, the extension moves in a receiving trough defined in the stop.

2. The utility knife as claimed in claim 1, wherein the retainer has a first wall with an outward protrusion, a second wall formed opposite to the first wall and having an inclined surface corresponding to the inclined top face of the pressing stop and a retaining hole connected with the extension and two side walls oppositely formed with each other, each side wall having a guided ridge formed on a free side thereof engaging the spaced apart walls of the first half cover, thereby allowing the retainer to slide between the spaced apart walls.

3. The utility knife as claimed in claim 2, wherein a second spring is provided between the seat and the protrusion of the first wall to provide recoil force to the retainer, such that when the inclined surface engages the inclined top face of the pressing stop, the second spring is compressed to store energy for the recoil of the retainer, and when the inclined surface fully engages the inclined top face of the pressing stop, the stored energy pulls the retainer back to its original position.

4. The utility knife as claimed in claim 2, wherein a hook is formed on a free end of the extension engaged in the retaining hole of the retainer.

5. The utility knife as claimed in claim 4, wherein the first spring comprises a leaf spring provided between the first half cover and the second half cover to facilitate opening the first half cover and the second half cover.

* * * * *